US005676184A

United States Patent [19]

Houser

[11] Patent Number: 5,676,184

[45] Date of Patent: Oct. 14, 1997

[54] SPRAY CAN NOZZLE CLEANING SYSTEM

[76] Inventor: Michael P. Houser, 835 Wells Fargo Dr., Jacksonville, Oreg. 97530

[21] Appl. No.: 563,755

[22] Filed: Nov. 29, 1995

[51] Int. Cl.[6] ..... B65B 1/04; B65B 3/04; B67C 3/02

[52] U.S. Cl. ..... 141/90; 239/106

[58] Field of Search ..... 141/90, 70; 134/169 R; 239/104, 106; 222/402.1

[56] References Cited

U.S. PATENT DOCUMENTS

| | | | |
|---|---|---|---|
| 5,119,991 | 6/1992 | Divers | 239/106 |
| 5,188,255 | 2/1993 | Du | 239/106 |
| 5,388,601 | 2/1995 | Mansuer | 134/169 R |
| 5,497,946 | 3/1996 | Laidler | 239/106 |
| 5,529,226 | 6/1996 | Alberth, Jr. | 222/402.1 |

*Primary Examiner*—Renee S. Luebke
*Assistant Examiner*—Timothy L. Maust
*Attorney, Agent, or Firm*—David O'Reilly

[57] ABSTRACT

An aerosol spray can nozzle cleaning system comprised of an adaptor for mounting on a pressurized aerosol spray can having a solvent formulated for a wide variety of materials. Preferably, solvent is a mixture of methanol, acetone, aromatic hydrocarbons and with a propane propellant. The adaptor is constructed to fit on the aerosol spray can of solvent and has a socket for receiving the spray tube of a clogged spray nozzle. The adaptor has a knurled surface to allow easy gripping with the fingers. The socket in the adaptor is constructed to receive and seal the spray tube of a spray nozzle to be cleaned. A clogged spray nozzle is cleaned by mounting it on the adaptor fitted on an aerosol can of solvent and pressing on the spray nozzle to force solvent through to clean clogged passageways.

10 Claims, 2 Drawing Sheets

SPRAY CAN NOZZLE CLEANING SYSTEM

BACKGROUND OF THE INVENTION

1. Field of the Invention

This invention relates to aerosol can spray nozzles and more particularly, relates to an aerosol can spray nozzle cleaning system including a solvent formula for cleaning spray nozzles.

2. Background Information

Numerous products come in aerosol spray cans that have spray nozzles, usually constructed of plastic. Such items are sold in paint, hardware, auto supply, supermarkets and a variety of stores. In some cases, when the aerosol can of paint or other material is purchased the entire can is used up immediately. However, often only a small portion of the material stored in the can is used, and then it is placed on a shelf for storage. After a period of time, the nozzle becomes clogged.

Presently, the primary method of cleaning the nozzle of aerosol cans after use is to turn the can upside down so that the pressurized material in the can can blow out and purge the nozzle. This procedure may help to clear the nozzle if the product such as paint, is still in liquid form; but it does not completely clean the used nozzle.

Other methods for clearing and cleaning aerosol can spray nozzles include removing the nozzles and soaking them in solvent, inserting a wire pin or small drill into the nozzle hole, blowing pressurized air through the nozzle or a combination of the previous methods. All of these methods are inconvenient, time consuming, messy and frequently are only partially effective, or fail to clean and clear the nozzle completely.

In some cases the nozzle cannot be sufficiently cleared and the spray nozzle must be replaced with a new nozzle. However, such replacement spray nozzles are not conveniently available in most commercial stores. If a user has several aerosol cans, a clean nozzle may be pirated from another unused aerosol can as an optional method; however, this may simply transfer the problem to the unused product.

Commonly, when an aerosol can is found to have a clogged nozzle, the result is that the owner will simply discard it. This means that it will be disposed of in the garbage to be taken away with trash pick-up. This is not only costly because the remaining can contents are lost, but is also dangerous, toxic to the environment and illegal in many locales; particularly if the can remains pressurized when discarded. Such cans, when overheated, can explode causing injury and, of course, the contents are often toxic materials.

It is therefore, one object of the present invention, to provide a safe and convenient method for cleaning spray nozzles of aerosol cans.

Still another object of the present invention is to allow cleaning of aerosol can spray nozzles by providing an adaptor for a can of solvent on which a spray nozzle requiring cleaning can be mounted.

Yet another object of the present invention is to provide a spray nozzle cleaning system, including a solvent capable of unclogging most nozzles installed in aerosol cans containing paint, lacquer, polyurethane or similar spray-on products.

Yet another object of the present invention is to provide a spray nozzle cleaning system, in which a clogged spray nozzle can be mounted on an adaptor fitting an aerosol can of cleaning solvent that will clean most materials from the nozzle.

Still another object of the present invention is to provide a spray nozzle cleaning system, including a method for mounting the spray nozzle and forcing pressurized solvent through the clogged nozzle until it is clean.

BRIEF DESCRIPTION OF THE INVENTION

The purpose of the present invention is to provide a safe, quick and efficient method of cleaning spray nozzles used on aerosol cans containing materials such as paint, lacquer, polyurethane and other products that can be sprayed.

The spray can nozzle cleaning system, of the present invention, involves the development of a solvent capable of unclogging most nozzles installed on aerosol cans that contain paint, lacquer, polyurethane and similar spray-on products. Preferably, the solvent is packaged in a pressurized aerosol can equipped with an appropriate adaptor. Of course, an aerosol can with a thin tube inserted into a nozzle, with the nozzle requiring cleaning to the other end, could be used; but this requires the use of both hands and results in a messy release of solvent that can be misdirected and emit from either, or both ends of the nozzle being cleaned.

The solvent developed for cleaning these spray nozzles is packaged in a pressurized aerosol can equipped with a universal adaptor that accepts a clogged nozzle. The formula of the solvent, stored in the pressurized can, is comprised of methanol (CAS #67-56-1) in the range of 30 to 40 percent, acetone (CAS #67-64-1) in the range of 30 to 40 percent, aromatic hydrocarbons (orange scent) up to 5 percent and propane (CAS #74-98-6) propellant in the range of 20 to 30 percent. The solvent is stored in a pressurized canister having a spray socket at the top for receiving a spray nozzle, as is known in the art.

To use the solvent to clean a spray nozzle from an aerosol can, a universal adaptor is provided that fits on the spray cavity tube of the aerosol can containing the solvent. The universal adaptor is mounted on the spray tube and includes a base tube socket for receiving and sealing the nozzle to be cleaned. When the nozzle is mounted on the adaptor, a seal is provided that only allows solvent to be emitted from the orifice of the spray nozzle.

Solvent is released from the aerosol can through the adaptor and clogged nozzle requiring cleaning by pressing the clogged nozzle against the adaptor with a pulsing action until solvent sprays from the nozzle. The use of the solvent can and adaptor permits the use of only one hand, and the solvent released through the orifice of the spray nozzle can be easily and safely directed away from the user. A cloth cover, over the hand pressing the nozzle, can be used to absorb the solvent spray to prevent it from polluting the air.

Preferably, the adaptor is constructed so that it may be produced by either a simple molding process or by a metal machining process. The adaptor, when installed on an aerosol can of the preferred solvent formula, allows clogged aerosol can spray nozzle to be easily and safely cleaned. The system of the spray can, solvent and adaptor can be safely used with clogged nozzles that have been used on spray paint, lacquer, polyurethane or other similar products that can clog the nozzle.

The cleaning adaptor for the solvent spray can is constructed to be universal and will provide a seal with the base of most common spray nozzle sizes. The adaptor for receiving spray can nozzles is constructed to be used easily with wet or slippery fingers. A roughened surface on the adaptor allows it to be quickly and easily mounted on the solvent spray can, or it can be permanently attached if desired.

The above and other novel features of the invention will be more fully understood from the following detailed description and the accompanying drawings, in which:

DETAILED DESCRIPTION OF THE INVENTION

Figure 1:
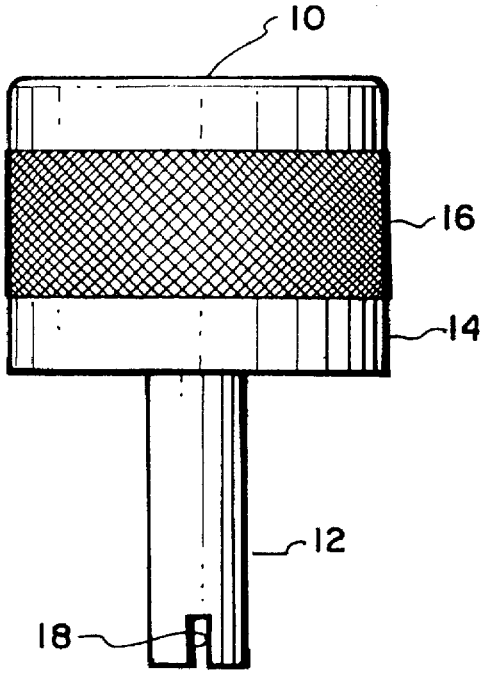
FIG. 1 is a side elevation of an adaptor for an aerosol can of solvent for use in the spray nozzle cleaning system.
Figure 2:
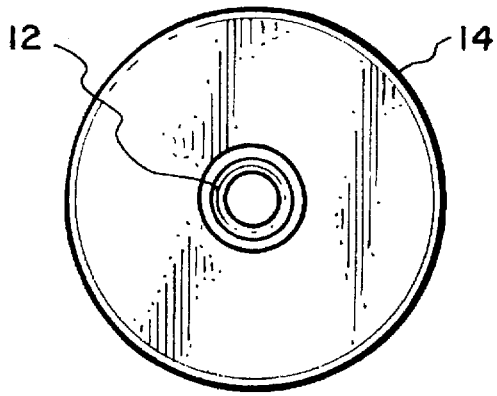
FIG. 2 is a top view of the adaptor of FIG. 1.
Figure 3:
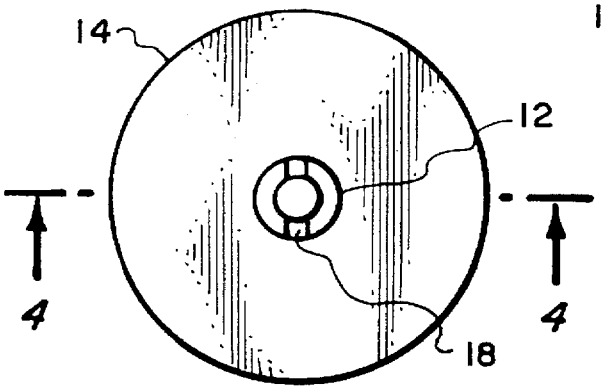
FIG. 3 is a bottom view of the adaptor of FIG. 1.

An adaptor for use with an aerosol can of solvent is illustrated in FIGS. 1 through 4. Aerosol can adaptor 10, has tubular connector 12 connected to cylindrical body 14, for receiving the spray nozzle to be cleaned. Preferably, the surface of adaptor body 14 has a roughened or knurled surface 16 so that it may be easily handled with fingers that may be slippery or wet with oil or grease. Slot 18, in connector tube 12, allows the connector to be inserted and frictionally fit an aerosol can of solvent.

Figure 4:
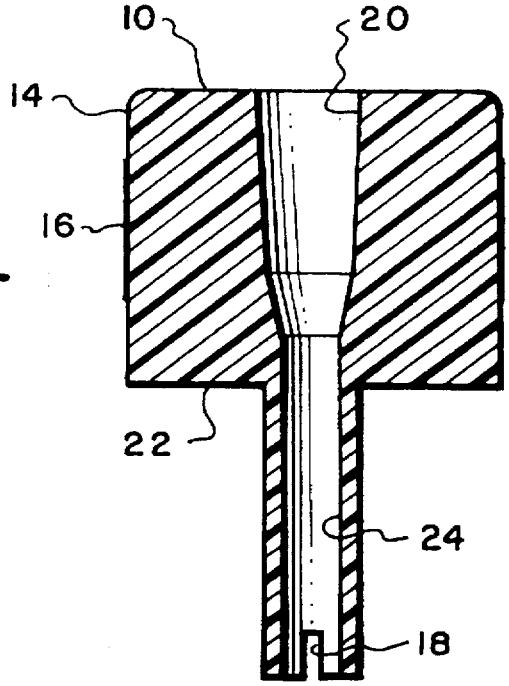
FIG. 4 is a sectional view of the solvent aerosol solvent can adaptor taken at 4—4 of FIG. 3.

As can be seen in the sectional view of FIG. 4, adaptor body 14 has a socket or passageway 20 for receiving the connecting tube of a spray nozzle to be cleaned, as will be described in greater detail hereinafter. Socket 20 tapers down at 22 to passageway 24, connecting adaptor 10 to a aerosol can of pressurized solvent.

Figure 5:
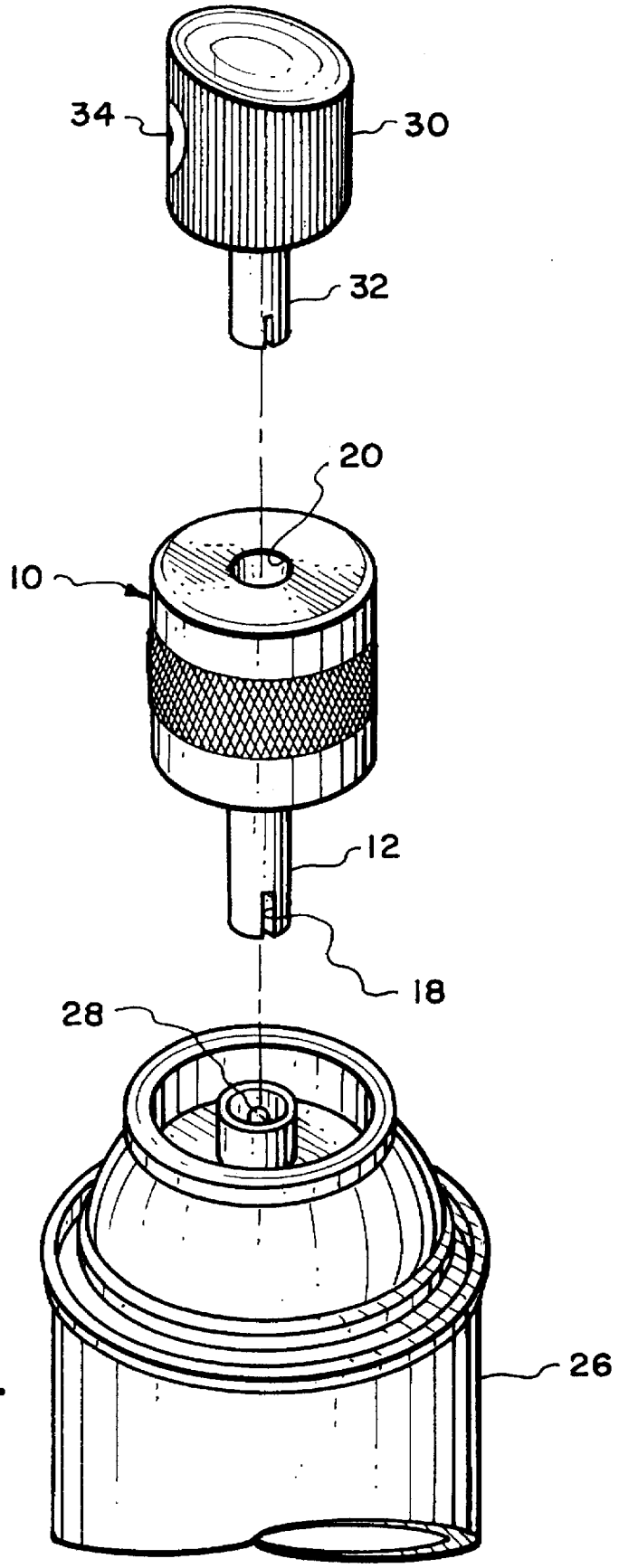
FIG. 5 is an exploded view illustrating the mounting of the adaptor and an aerosol spray can nozzle to be cleaned on the canister of pressurized solvent.

A cleaning system is shown in the exploded view of FIG. 5, that can be used for cleaning a spray can nozzle that may be clogged. Preferably, the system would be used as soon as possible after a spray can nozzle has been used to prevent clogging and will conserve solvent. If a spray can nozzle is completely clogged, then it might take several "shots" of solvent before it can be completely freed of material clogging the passageways.

A spray solvent is stored in a pressurized aerosol can 26 and if desired, can be a solvent having properties for the particular material trying to be cleaned from a spray can nozzle. However, a solvent that has universal application to a wide variety of materials is preferred. A solvent for use in pressurized can 26 would consist of fluids that are known to have a wide range of applications to paint, lacquer, polyurethane and similar spray-on products.

Materials that are known to be effective solvents for such spray-on components are methanol and acetone. Therefore, a solvent for storage in pressurized aerosol can 26, is comprised of methanol in the range of 30 to 40 percent, acetone in the range of 30 to 40 percent and aromatic hydrocarbon in the range of up to 5 percent and propane in the range of 20 to 30 percent. In the preferred embodiment, the solvent would consist of methanol (CAS #67-56-1) at approximately 37 percent, acetone (CAS #67-64-1) of approximately 36 percent, aromatic hydrocarbon of approximately 2 percent and a propellant of propane (CAS #74-98-6) of approximately 25 percent. Also, in the preferred embodiment the aromatic hydrocarbon would be an orange scent hydrocarbon. This mixture is stored under pressure in aerosol can 26 for use as a solvent, and would be suitable to clean most materials that could clog spray nozzles.

To use the spray can nozzle cleaning system of the invention, aerosol can adaptor 10 is fitted on solvent aerosol can 26 with connecting tube 12 being inserted in the usual cavity 28 in aerosol solvent can 26. The clogged spray can nozzle 30 is then mounted on top of adaptor 10 with connecting tube 32 inserted in socket 20. Taper 22 (FIG. 4) in adaptor 10, squeezes the end of connector tube 32 on spray can nozzle 30 providing a seal to prevent solvent from discharging into the atmosphere.

To clean spray can nozzle 30, which may be clogged, it is first inserted in socket 20 of adaptor 10, mounted on aerosol can solvent 26. Preferably, one would shake aerosol can of solvent 26 to stir-up the mixture. With aerosol spray can nozzle 30 fully inserted in socket 20, solvent can 26 is held in the hand with orifice 34 of spray can nozzle 30 pointed away from the user. Spray can nozzle 30 is cleaned by depressing the nozzle on adaptor 10 with a pulsing action. If spray can nozzle 30 is severely clogged, it may take several depressions of nozzle 30 before the passageway through connecting tube 32 to orifice 34 is cleared.

However, if nozzle 30 is cleaned shortly after use, a single pulse of solvent from spray can 26 should be sufficient to clear the nozzle passageways. Optionally, a person cleaning a nozzle would wrap a cloth over the hand and spray can 26 to absorb any cleaning spray to prevent pollution of the atmosphere. Cleaned nozzle 30 can then be easily removed from adaptor 10 and carefully replaced on the aerosol can of paint or other material for later use.

A unique feature of the invention is that the nozzle adaptor 10 is designed for safe and reliable use repeatedly with additional cans of solvent, or can be used on aerosol cans that contain a different solvent if desired. Preferably, adaptor 10 is made of a molded plastic or is a machined metal adaptor such as noncorrosive aluminum suitable for use on aerosol spray cans.

Thus, there has been disclosed a safe and efficient system for cleaning spray can nozzles. The system involves a particular solvent formula adaptable for a wide variety of materials, and an adaptor for mounting a spray nozzle to be cleaned. The spray can adaptor mounts on a can of solvent and the spray can nozzle requiring cleaning, fits into the adaptor providing a seal. Pressing on the nozzle and adaptor with a pulsing action forces solvent through the clogged spray nozzle cleaning the passageway and orifices.

This invention is not to be limited by the embodiment shown in the drawings and described in the description which is given by way of example and not of limitation, but only in accordance with the scope of the appended claims.

What is claimed is:

1. An aerosol spray can nozzle cleaning system comprising;

a can of solvent for dissolving materials that clog spray can nozzles, said can of solvent having a valve and a valve stem for activating said valve;

an adaptor constructed to fit on said valve stem, said adapter constructed to receive a nozzle stem of a clogged nozzle;

said adapter having a passageway for delivering a solvent from said can of solvent through said clogged nozzle when said nozzle stem is fitted on said adapter and a downward pressure is applied to activate said valve on said can of solvent releasing solvent through said adapter and said clogged nozzle;

whereby said clogged nozzle may be cleared of clogging material and restored for use on said spray can.

2. The system according to claim 1 in which said solvent in said can consists of a mixture of methanol, acetone, a scent and a propellant.

3. The system according to claim 2 in which said solvent consists of 20 to 30 percent methanol and 20 to 40 percent acetone.

4. The system according to claim 3 in which said solvent consists of 37% methanol, 36% acetone, 5% aromatic hydrocarbon and 25% propane propellant.

5. The system according to claim 1 in which said adapter comprises a cylindrical body having a socket for receiving and sealing against said nozzle stem on said spray can nozzle.

6. The system according to claim 5 in which said socket in said adaptor is tapered to receive and seal against nozzle stems from a wide variety of spray can nozzles.

7. The system according to claim 6 in which said adaptor has a roughened surface on the exterior of said cylindrical body to make it easy to handle with wet or slippery fingers.

8. The system according to claim 4 in which said adapter comprises a cylindrical body having a socket for receiving and sealing against said nozzle stem on said spray can nozzle.

9. The system according to claim 8 in which said socket in said adaptor is tapered to receive and seal against nozzle stems from a wide variety of spray can nozzles.

10. The system according to claim 9 in which said adaptor has a roughened surface on the exterior of said cylindrical body to make it easy to handle with wet or slippery fingers.

* * * * *